US010281233B2

(12) United States Patent
Baker

(10) Patent No.: US 10,281,233 B2
(45) Date of Patent: May 7, 2019

(54) RECOIL REDUCER

(75) Inventor: Travis Baker, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 688 days.

(21) Appl. No.: 13/615,897

(22) Filed: Sep. 14, 2012

(65) Prior Publication Data

US 2014/0109452 A1 Apr. 24, 2014

Related U.S. Application Data

(60) Provisional application No. 61/541,726, filed on Sep. 30, 2011.

(51) Int. Cl.
*F41C 23/06* (2006.01)

(52) U.S. Cl.
CPC ..... *F41C 23/06* (2013.01)

(58) Field of Classification Search
CPC ..... F41C 23/14; F41C 23/06; F41C 23/08; F41C 23/04; F41C 23/20
USPC ..... 42/1.06, 71, 72, 73, 74
See application file for complete search history.

(56) References Cited

U.S. PATENT DOCUMENTS

| | | | |
|---|---|---|---|
| 202,606 | A | 4/1878 | Thornton et al. |
| 383,372 | A | 5/1888 | Rostel |
| 398,595 | A | 2/1889 | Emmens |
| 449,711 | A | 4/1891 | von Skoda |
| 458,505 | A | 8/1891 | von Skoda |
| 617,110 | A | 1/1899 | Lynch |
| 1,040,001 | A | 10/1912 | Olsson |
| 1,187,269 | A | 6/1916 | Cross |
| 1,213,951 | A | 1/1917 | Ringsmith |
| 1,222,291 | A | 4/1917 | Huntley |
| 1,331,074 | A | 2/1920 | Marble |
| 1,418,532 | A | 6/1922 | Caldwell |

(Continued)

FOREIGN PATENT DOCUMENTS

| | | |
|---|---|---|
| BE | 351672 | 5/1928 |
| CH | 43050 | 1/1908 |

(Continued)

OTHER PUBLICATIONS

International Search Report for PCT/US2012/056882 dated Dec. 12, 2012.

(Continued)

*Primary Examiner* — John Cooper
(74) *Attorney, Agent, or Firm* — Womble Bond Dickinson (US) LLP

(57) ABSTRACT

A system for reducing a recoil force transmitted upon firing of a firearm. The system includes a first stock portion having a first proximal end coupled to a receiver of the firearm and a first distal end having a distal contact surface, a second stock portion having a second proximal end with a proximal contact surface and a second distal end having a rear contact surface, and a resilient insert positioned between the distal contact surface and the proximal contact surface which is compressible by the relative motion between the first and second stock portions. The gun stock further includes a guide structure extending between the first stock portion and the second stock portion to control the relative motion between the first and second stock portions in response to the recoil force transmitted upon firing of the firearm.

33 Claims, 10 Drawing Sheets

(56) References Cited

U.S. PATENT DOCUMENTS 1,437,796 A 12/1922 Fisher
1,457,961 A 6/1923 Browning
1,468,354 A * 9/1923 Caretto ..... F41C 23/14 42/74
1,497,096 A 6/1924 Eriksen
1,805,273 A 5/1931 Ammann
1,835,715 A 12/1931 McCoy
2,073,755 A 3/1937 Poate
D105,358 S 7/1937 Anderson
2,091,010 A 8/1937 Pachmayr
2,259,569 A 10/1941 King
2,344,752 A * 3/1944 Utz ..... F41C 23/08 42/74
2,365,188 A 12/1944 Gorton
2,415,952 A 2/1947 Loomis
2,455,438 A * 12/1948 Oppold ..... F41C 23/06 42/73
2,464,010 A 3/1949 Vonella
2,468,349 A 4/1949 Stewart
D158,745 S 5/1950 Harbeke
2,522,192 A 9/1950 Porter
D162,217 S 2/1951 Pachmayr
2,627,686 A 2/1953 Shockey
2,667,005 A 1/1954 Weis
2,677,207 A * 5/1954 Stewart ..... F41C 23/08 264/135
2,679,192 A 5/1954 Seeley et al.
2,731,753 A 1/1956 Mathieu
2,791,155 A 5/1957 Thiel
2,800,057 A 7/1957 Hoopes
2,845,737 A 8/1958 Hoyer
2,977,855 A 4/1961 Catlin et al.
3,000,268 A 9/1961 Robinson
3,018,694 A 1/1962 Browning
3,019,543 A 2/1962 Ducharme
D192,922 S 5/1962 Pachmayr et al.
3,105,411 A 10/1963 Browning
3,115,063 A 12/1963 Browning
3,122,061 A 2/1964 Atchisson
3,147,562 A 9/1964 Pachmayr et al.
3,191,330 A 6/1965 Olson
3,208,348 A 9/1965 Lee
3,263,359 A 8/1966 Pachmayr
3,290,815 A 12/1966 Edwards
3,300,889 A 1/1967 Baker
3,335,515 A 8/1967 Bennett
3,363,352 A 1/1968 Pachmayr
3,381,405 A 5/1968 Edwards
3,405,470 A 10/1968 Weseman
3,408,062 A 10/1968 Baker
3,410,175 A 11/1968 Brooks et al.
3,417,660 A 12/1968 Harbrecht
3,461,589 A 8/1969 Vironda
3,491,473 A * 1/1970 Eastin ..... F41C 23/06 42/74
3,514,889 A 6/1970 Pachmayr
3,580,132 A 5/1971 Vartanian
3,609,903 A 10/1971 Pachmayr et al.
3,650,060 A 3/1972 Schubert
3,683,534 A 8/1972 Davis
3,696,544 A 10/1972 Webb
3,714,726 A 2/1973 Braun
3,739,515 A 6/1973 Koon
3,763,742 A 10/1973 Kotas et al.
3,783,739 A 1/1974 Perrine
3,911,546 A 10/1975 Schrock et al.
3,977,923 A 8/1976 Uelzmann
4,048,901 A 9/1977 Ghisoni
4,088,057 A 5/1978 Nasypany
4,112,605 A 9/1978 Staub
4,126,077 A 11/1978 Quesnel
4,127,953 A 12/1978 McBride
4,156,979 A 6/1979 Katsenes
4,164,825 A 8/1979 Hutchison
4,167,890 A 9/1979 Adams
4,203,243 A 5/1980 Hickman
4,203,244 A 5/1980 Hickman
4,279,091 A 7/1981 Edwards
4,316,342 A 2/1982 Griggs
4,361,072 A 11/1982 Karlsen
4,439,943 A 4/1984 Brakhage
4,455,684 A 6/1984 Johnson
4,492,050 A 1/1985 Kagehiro
4,503,632 A 3/1985 Cuevas
4,504,604 A 3/1985 Pilkington et al.
4,512,101 A 4/1985 Waterman, Jr.
4,514,921 A 5/1985 Burkleca
4,551,937 A 11/1985 Seehase
4,553,469 A 11/1985 Atchisson
4,644,930 A 2/1987 Mainhardt
4,663,877 A * 5/1987 Bragg ..... F41C 23/14 42/71.01
4,683,671 A 8/1987 Farrar
4,689,911 A 9/1987 White
4,732,075 A 3/1988 Hurd
4,769,937 A * 9/1988 Gregory ..... F41C 23/06 42/74
4,833,808 A 5/1989 Strahan
4,869,151 A 9/1989 Chahin
4,877,374 A 12/1989 Santarossa
4,896,446 A * 1/1990 Gregory ..... F41C 23/14 42/72
4,910,904 A 3/1990 Rose
4,913,031 A 4/1990 Bossard et al.
4,922,641 A * 5/1990 Johnson ..... F41C 23/06 42/74
4,924,616 A 5/1990 Bell
4,934,084 A 6/1990 Thomas
4,945,666 A 8/1990 Henry et al.
4,949,491 A 8/1990 Broske
4,956,932 A * 9/1990 Cupp ..... F41C 23/08 42/74
4,982,521 A 1/1991 Sutton et al.
4,986,018 A 1/1991 McDonald, Jr.
4,998,367 A 3/1991 Leibowitz
5,031,348 A 7/1991 Carey
5,044,351 A 9/1991 Pfeifer
5,069,110 A 12/1991 Menck
5,233,774 A 8/1993 Leibowitz
5,235,765 A 8/1993 Chesnut
5,249,385 A 10/1993 Vang et al.
5,265,366 A 11/1993 Thompson
5,272,956 A 12/1993 Hudson
5,305,678 A 4/1994 Talbot et al.
5,339,789 A 8/1994 Heitz
5,343,649 A 9/1994 Petrovich
5,362,834 A 11/1994 Schäpel et al.
5,375,360 A 12/1994 Vatterott
5,392,553 A * 2/1995 Carey ..... F41C 23/14 42/73
5,410,833 A * 5/1995 Paterson ..... F41C 23/06 42/73
5,435,092 A 7/1995 Brodie
5,457,901 A 10/1995 Gernstein et al.
5,461,813 A 10/1995 Mazzola
5,471,776 A 12/1995 Chesnut et al.
5,491,917 A 2/1996 Dilhan et al.
5,513,730 A 5/1996 Petrovich et al.
5,524,374 A 6/1996 Gernstein
D376,188 S 12/1996 Riecken
5,585,590 A 12/1996 Ducolon
5,617,664 A 4/1997 Troncoso
5,634,289 A 6/1997 Wascher
5,661,255 A 8/1997 Webb, III
5,669,168 A 9/1997 Perry
5,722,195 A 3/1998 Bentley et al.
5,756,195 A 5/1998 Allen et al.
5,909,002 A 6/1999 Atchisson
5,974,718 A * 11/1999 Bentley ..... F41C 23/06 42/73
5,979,098 A 11/1999 Griggs
5,983,549 A 11/1999 Battaglia

(56) References Cited

U.S. PATENT DOCUMENTS

| | | | | |
|---|---|---|---|---|
| 6,026,527 | A | 2/2000 | Pearce | |
| 6,055,760 | A | 5/2000 | Cuson et al. | |
| 6,223,458 | B1 | 5/2001 | Schwindendorf et al. | |
| 6,305,115 | B1 * | 10/2001 | Cook | F41C 23/08 42/74 |
| 6,311,423 | B1 | 11/2001 | Graham | |
| 6,314,859 | B1 | 11/2001 | Weichert et al. | |
| 6,382,073 | B1 | 5/2002 | Beretta | |
| 6,481,143 | B2 * | 11/2002 | McCarthy | F41C 23/06 42/71.01 |
| 6,578,464 | B2 | 6/2003 | Ebersole, Jr. et al. | |
| 6,594,935 | B2 | 7/2003 | Beretta | |
| 6,604,445 | B2 | 8/2003 | Sevastian | |
| 6,637,142 | B1 | 10/2003 | Reynolds | |
| 6,655,068 | B2 | 12/2003 | Murello et al. | |
| 6,668,478 | B2 | 12/2003 | Bergstrom | |
| 6,678,986 | B2 | 1/2004 | Roush | |
| 6,684,547 | B2 | 2/2004 | Poff, Jr. | |
| 6,722,254 | B1 | 4/2004 | Davies | |
| 6,834,455 | B2 | 12/2004 | Burigana | |
| 6,834,456 | B2 | 12/2004 | Murello | |
| 6,889,461 | B2 | 5/2005 | Vignaroli et al. | |
| 7,124,529 | B1 * | 10/2006 | Havelka, Jr. | F41C 23/08 42/74 |
| 7,493,717 | B2 * | 2/2009 | Gussalli Beretta | F41C 23/06 42/74 |
| 7,588,122 | B2 | 9/2009 | Brittingham | |
| 7,594,464 | B2 | 9/2009 | Dueck | |
| 7,823,313 | B2 * | 11/2010 | Faifer | F41C 23/06 42/1.06 |
| 2001/0011434 | A1 | 8/2001 | Beretta | |
| 2002/0088161 | A1 | 7/2002 | Sims | |
| 2003/0079394 | A1 * | 5/2003 | Poff, Jr. | F41C 23/06 42/74 |
| 2003/0154640 | A1 * | 8/2003 | Bragg | F41C 23/08 42/74 |
| 2003/0182837 | A1 * | 10/2003 | Burigana | F41C 23/06 42/74 |
| 2003/0200692 | A1 | 10/2003 | Lakatos et al. | |
| 2004/0025680 | A1 | 2/2004 | Jebsen et al. | |
| 2004/0069137 | A1 | 4/2004 | Jebsen et al. | |
| 2004/0144011 | A1 | 7/2004 | Vignaroli et al. | |
| 2004/0217205 | A1 | 11/2004 | Kohs et al. | |
| 2006/0168869 | A1 * | 8/2006 | Daul | F41C 23/08 42/74 |
| 2007/0175077 | A1 * | 8/2007 | Laney | F41C 23/06 42/74 |
| 2008/0178508 | A1 * | 7/2008 | Cinciu | F41C 23/06 42/1.06 |
| 2010/0122482 | A1 * | 5/2010 | Simms | F41C 23/08 42/1.06 |
| 2011/0138668 | A1 | 6/2011 | Thomas | |
| 2011/0179687 | A1 | 7/2011 | Caravaggi et al. | |

FOREIGN PATENT DOCUMENTS

| | | | |
|---|---|---|---|
| DE | 2231543 | | 1/1974 |
| DE | G8329345.C | U1 | 12/1983 |
| DE | G3705247.4 | U1 | 5/1987 |
| EP | 0460362 | A3 | 6/1992 |
| EP | 0557209 | | 1/1996 |
| EP | 0611189 | B1 | 7/1997 |
| EP | 0523535 | B1 | 10/1997 |
| EP | 0940646 | A2 | 9/1999 |
| EP | 1122507 | A2 | 8/2001 |
| EP | 0802387 | B1 | 1/2002 |
| EP | 1348928 | A1 | 1/2003 |
| EP | 1348928 | A1 | 10/2003 |
| EP | 1396697 | A2 | 3/2004 |
| FR | 969669 | | 12/1950 |
| FR | 1193803 | | 11/1959 |
| WO | WO-00/029803 | A1 | 5/2000 |
| WO | WO-03/054625 | A1 | 7/2003 |
| WO | WO-03/104737 | A1 | 12/2003 |
| WO | WO-03/104738 | A1 | 12/2003 |
| WO | WO-03/104739 | A1 | 12/2003 |
| WO | WO-05/038706 | A2 | 4/2005 |

OTHER PUBLICATIONS

Written Opinion for PCT/US2012/056882 dated Dec. 12, 2012.

Kick-Eez Recoil Pad by Sorbothane, Inc., product discovered in 1997, Shotgun Report by the Technoid from www.shotgunreport.com.

Chart comparing Hardness of Polyurethane Elastomers vs. Conventional Plastics & Rubbers, discovered Apr. 19, 2006 at http://www.calce.umd.edu/general/Facilities/images/image012.gif.

Technical data regarding polyurethanes, discovered Apr. 19, 2006, 4 pages, Sunray, Inc., Polyurethan Products, Inc., Rutherfordton, NC, U.S.A., http://www.sunray-inc.com/techdata_print_friendly.html.

Technical data regarding Polyurethane Thermoplastic Elastomer, discovered Apr. 19, 2006 at http://www.azom.com/details.asp?ArticleID=852, abstracted from Plascams.

Desmopan® thermoplastic polyurethane (TPU) resin, discovered Apr. 19, 2006 at http://www.bayermaterialsciencenafta.com/products/index.cfm?mode=docs&pp_num=EB7C5742-0773-8282-C900515838BF5 . . .

Product Information for Texin® 185: Thermoplastic Polyurethane, Aug. 1999, 8 pages, Bayer MaterialScience LLC, Pittsburgh, PA, U.S.A.

Technical data regarding Durometer . . . the measure of the hardness of rubber compounds, 2 pages, discovered Apr. 19, 2006 at http://www.rubbermill.com/durometer.html.

Ultrasoft TPEs March Forward, Injection Molding Magazine, Jul. 2003, 3 pages, reprinted by GLS Corporation, McHenry, IL, U.S.A.

LimbSaver Master Catalog, 2002, 20 pages, Sims Vibration Laboratory.

Promotional flyer for Gooey Pads, Jan. 2002, 1 page, Trapdude.com, Fairfield, CA, U.S.A.

James W. Bequette, Editor's Gallery: Good News—Old & New, Shooting Times, Feb. 2002, 1 page.

Promotional Product Guide for Kick-Eez® Recoil Pads, discovered Feb. 5, 2002 at http://www.sorbothane.com/page3b.htm.

Field Guns, Beretta USA Product Catalogue, 2 pages, dioscovered Aug. 19, 2005 at http://www.berettausa.com/product/catalogue_page_field_guns_intro.htm.

Report of Material Analysis: Compositional analysis of two rubber materials on a new rifle recoil pad, Dec. 2, 2005, 2 pages, Fitzsimmons & Associates, Inc., West Chicago, IL, U.S.A.

Test Report: Dynamic testing on two pads—"Benelli" and "Experimental", Dec. 28, 2005, 5 pages, Akron Rubber Development Laboratory, Inc., Akron, OH, U.S.A.

Promotional material for ComforTech, discovered Apr. 21, 2006 at http://www.benelliusa.com/firearms/comforTech.tpl.

A Confidential Presentation to Remington, Nov. 6, 2003, 46 pages, The Gamma Group, Transformational Defense Industries, Inc.

Mark Three Vector 22 Shooting System and Mark Three Black Mamba BM22/SS Shooting System product descriptions and specifications, 2 pages.

* cited by examiner

Force vs. Time for Target Loads

Force vs. Time for Magnum Loads

RECOIL REDUCER

RELATED APPLICATIONS

The present patent application is a formalization of previously filed, U.S. Provisional Patent Application Ser. No. 61/541,726, filed Sep. 30, 2011 by the inventors named in the present application. This patent application claims the benefit of the filing date of the cited Provisional patent application according to the statutes and rules governing provisional patent applications, particularly 35 U.S.C. § 119(a)(i) and 37 C.F.R. § 1.78(a)(4) and (a)(5). The specification and drawings of the Provisional patent application referenced above are specifically incorporated herein by reference as if set forth in their entirety.

TECHNICAL FIELD

The present invention relates generally to firearms and in particular to devices for reducing the recoil force in firearms, and in particular to recoil reducing devices positioned within the stock of the firearm.

BACKGROUND

In firearms, a recoil (or kickback) force is the change in backward momentum of a gun when it is discharged. Without a system or mechanism for reducing the recoil upon firing, the backward momentum of the gun is substantially equivalent to the forward momentum of the projectile(s) and exhaust gases. This backward momentum is transferred to the ground through the body of the shooter. In the case of long guns, this backward momentum is typically transferred to the shooter via the gun stock. Since recoil forces can be substantial, a shooter may experience discomfort or pain when firing, for example, powerful guns such as high caliber rifles, shotguns, or the like.

Previously, gun manufacturers have attempted to mitigate the discomfort or pain caused by the recoil forces by adding a recoil pad to the butt end of the gun stock. The recoil pad often includes a contoured profile that matches the curve of the shooter's shoulder to re-distribute the recoil forces over a greater surface area. The recoil pad is also generally made of a resilient material that serves to reduce and extend the recoil forces, and which cushions the impact to the shooter. In general, the thicker the recoil pad or the softer the material used to form the recoil pad, the greater the reduction in peak energy and the more comfort provided to the shooter.

There are practical limits to the thickness and softness of the recoil pads, however. For instance, recoil pads mounted to the butt end of a gun stock will begin to buckle to one side or to bow asymmetrically during firing if the thickness of the recoil pad is too great or if the stiffness of the material forming the recoil pad is too low (e.g. the pad is too soft). This bucking or bowing may allow the butt end of the gun stock to shift laterally at the moment of firing. Thus, previous gun stock designs have necessarily been limited in their ability to provide gun stock designs which absorb and reduce the recoil forces so as to avoid the undesirable deformation of the recoil pads.

The present disclosure seeks to address the problems presented in the prior art by providing a recoil reducing apparatus, a gun stock incorporating the recoil reducing apparatus, and a method for reducing the recoil forces transmitted to the shooter through a gun stock without affecting the lateral stability of the firearm.

SUMMARY

In one embodiment of the disclosure, a system for reducing a recoil force transmitted from a firearm to a shooter is provided. The system for reducing the recoil force can be used with a variety of firearms, typically long guns such as rifles and shotguns, and generally will be formed with or incorporated into the gun stock of the firearm. The system generally includes a forward or first stock portion of a gun stock having a first proximal end coupled to the receiver of the firearm and a first distal end defining a distal contact surface, a rearward or second stock portion of the gun stock having a second proximal end defining a proximal contact surface spaced from the distal contact surface, and a second distal end having a rear surface. The first and second stock portions generally define the structure of the gun stock and generally can be formed from substantially solid and/or rigid materials.

A resilient insert will be received between the distal contact surface of the first stock portion and the proximal contact surface of the second stock portion. The resilient insert generally can include a body formed from a resilient, flexible and/or deformable material adapted to be compressible by the relative motion between the two contact surfaces. The system can further include a guide structure extending between the first stock portion and the second stock portion to control the relative motion between the first stock portion and the second stock portion and substantially restrict or retard twisting or binding motions in response to the recoil force upon firing.

In another aspect of the disclosure, the guide structure of the system for reducing the recoil force can further include a first plate mounted to the distal contact surface of the first stock portion, a second plate mounted to the proximal contact surface of the second stock portion, and one or more guide rods which are slidably coupled between the first plate and the second plate, and which are generally configured to control the relative motion of the first and second stock portions along a single translational axis or degree of freedom. The system also can include the resilient insert positioned between the first plate and the second plate which is adapted to be compressed by the relative motion between the first and second stock portions to dampen the recoil force as it is transmitted from the first stock portion to the second stock portion. The resilient insert further can include a cheek piece or pad formed as a portion thereof.

In another aspect of the disclosure, a method for reducing recoil forces transmitted through a gun stock of a firearm is provided including moving a first stock portion of a gun stock of the firearm toward a second stock portion of the gun stock upon firing of a round of ammunition, the first stock portion including a first proximal end coupled to a receiver of the firearm and a first distal end having a distal contact surface and the second stock portion including a second proximal end having a proximal contact surface and a second distal end having a rear surface. As the first stock portion moves toward the second stock portion, the method also includes guiding the first stock portion in a linear path toward the second stock portion and compressing a resilient insert mounted between the first and second stock portions sufficient to cause a reduction in the recoil force. As the recoil force dissipates, the method further includes decompressing the resilient insert so as to move the first and second stock portions away from each other.

These and various other advantages, features, and aspects of the present invention will become apparent and more readily appreciated from the following detailed description of the embodiments taken in conjunction with the accompanying drawings, as follows.

Figure 1:
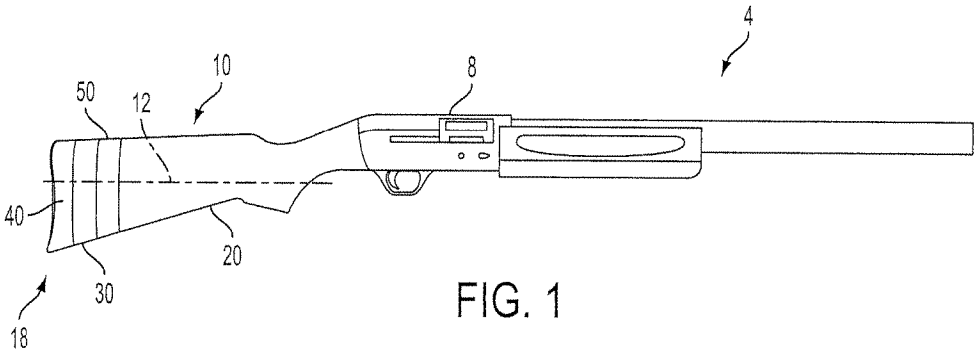
FIG. 1 is a perspective view of a firearm incorporating a recoil reducer in accordance with a representative embodiment of the disclosure.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION

The following description is provided as an enabling teaching of exemplary embodiments. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances, and are a part of the invention. Thus, the following description is provided as illustrative of the principles of the embodiments and not in limitation thereof, since the scope of the invention is defined by the claims.

Definitions

In describing and claiming the present invention, the following terminology will be used.

The singular forms "a," "an," and "the" include plural references unless the context clearly dictates otherwise. Thus, for example, reference to "a guide rod assembly" includes reference to one or more of such structures, and "a resilient material" includes reference to one or more of such materials.

As used herein, "longitudinal axis" generally refers to the long axis or centerline of a gun stock.

As used herein, "transverse" generally refers to a direction that cuts across a referenced plane or axis at an angle with respect to the referenced plane or axis.

As used herein, "rigid" generally refers to materials, structures or devices having a high modulus of elasticity, such as that of wood, metal and various composite and synthetic materials, or a relatively high degree of stiffness.

As used herein, "resilient" generally refers to materials, structures or devices having a modulus of elasticity and a degree or amount of stiffness that is generally lower than the modulus of elasticity of rigid materials, and can include, for example and without limitation, compressible or elastic materials such as rubber, urethane or other elastomeric materials, coil springs, fluid-filled springs or cylinders, and the like.

As used herein, "substantial" or "substantially", when used in reference to a quantity or amount of a material or a specific characteristic thereof, refers to an amount that is sufficient to provide an effect that the material or characteristic was intended to provide. The exact degree of deviation allowable may in some cases depend on the specific context.

Embodiments of the Disclosure

Illustrated in FIGS. 1-11 are several representative embodiments of a system for reducing a recoil force transmitted upon firing of a firearm. These embodiments include a gun stock having a recoil reducer included therein, the recoil reducer, and various methods for reducing a recoil force transmitted from a firearm to a user, or shooter, of the firearm. As described below, the system for reducing a recoil force of the present disclosure provides several significant advantages and benefits over other devices and methods for reducing the recoil force transmitted to a shooter. However, the recited advantages are not meant to be limiting in any way, as one skilled in the art will appreciate that other advantages may also be realized upon practicing the present invention.

Furthermore, the embodiments described herein illustrate the use of the recoil reducer with a long gun having stock which is typically supported against the shoulder of the shooter, e.g. such as a rifle or shotgun. It is to be understood, nevertheless, that the recoil reducer can also be used with various other types of firearms, including short-barreled shotguns and rifles, handguns, and other types of firearms which may also use a stock-like member to support the firearm against the shoulder or another body part of the shooter. In addition, the gun stock may include various configurations of stock systems, such as rifle or shotgun stocks, an assault rifle style (ARS) stock, folding stocks, or the like.

Figure 2:
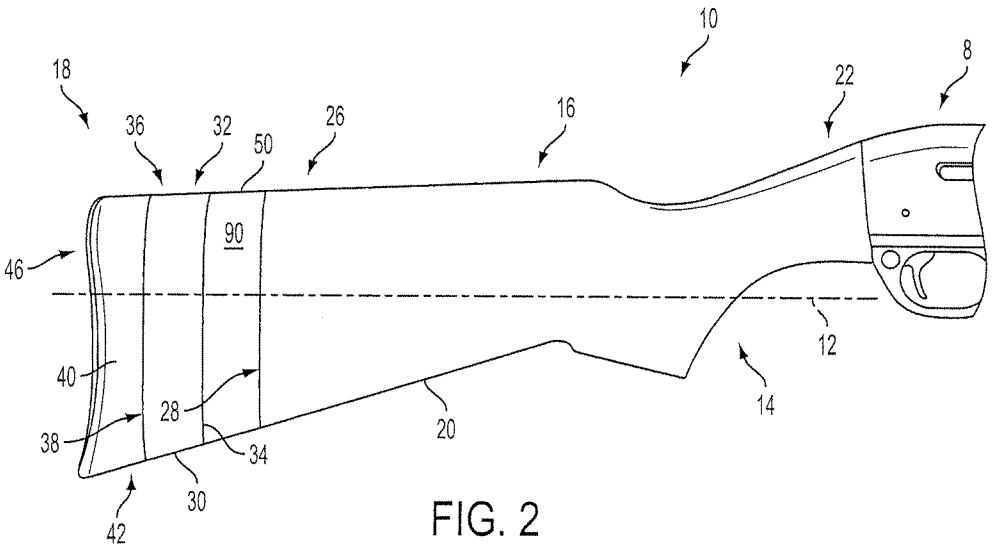
FIG. 2 is a close-up side view of the gun stock and recoil reducer of FIG. 1.

FIGS. 1-2 illustrate an exemplary embodiment of the present disclosure which includes a firearm 4 having a stock 10 with a longitudinal axis 12. The gun stock 10 generally can comprise a forward or first stock portion 20, a rearward or second stock portion 30, and a recoil reducer 50 positioned between the two stock portions to define the gun stock 10 of the firearm. The first stock portion 20 includes a proximal end 22 coupled to a receiver 8 of the firearm, and a distal end 26 terminating in a distal or first contact surface 28. The second stock portion 30 has a proximal end 32 with a proximal or second contact surface 34 that is spaced apart from the first contact surface 28 of the first stock portion 20, and a distal end 36 having a rear surface 38. The first stock portion 20 and the second stock portion 30 of the gun stock 10 may be made from a material comprising a wood, a metal, a plastic, a carbon fiber, or any other substantially-rigid material, naturally occurring and/or synthetic, that is suitable for use in a gun stock.

As shown, the recoil reducer 50 is positioned between the distal end 26 of the first stock portion 20 and the proximal end 32 of the second stock portion 30. Typically, the recoil reducer 50 may be located towards the butt end 18 of the stock 10, between the shooter's face and the shooter's shoulder. In other embodiments, however, the recoil reducer may be positioned at other locations in the gun stock, such as near the hand grip 14 and forward of the cheek area 16 of the stock. This forward location has the advantage of minimizing the movement of the gun stock relative to the shooter's face, thereby reducing potential effects of the recoil action to the shooter's face.

Figure 3:
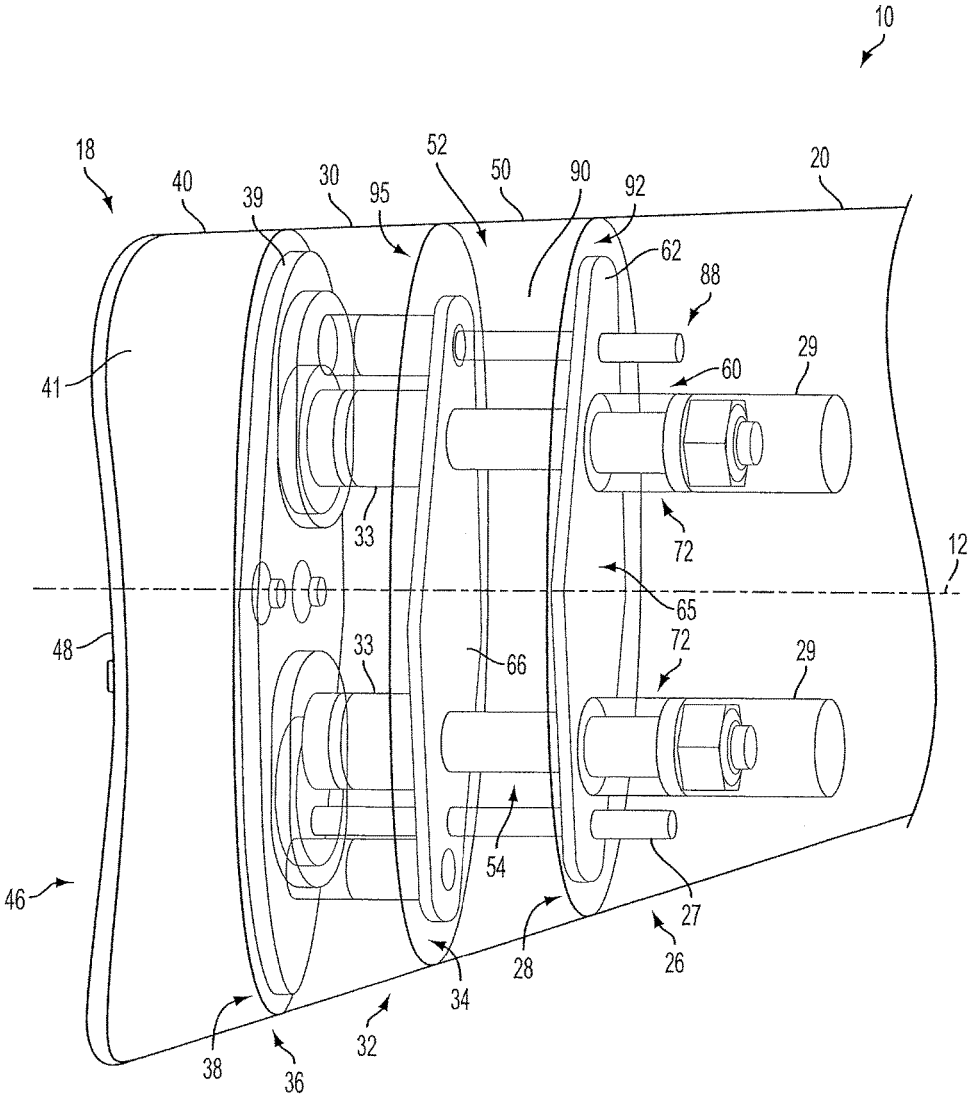
FIG. 3 is a schematic view of the gun stock and the recoil reducer of FIGS. 1-2.

As illustrated in FIG. 3, the recoil reducer 50 generally includes a compression zone portion 52 and a guide zone portion 54. The compression zone portion 52 generally includes a resilient insert 90 and is configured to absorb the recoil forces during the discharge of the firearm, thereby minimizing the effects on the shooter. The compression zone portion 52 may also include an elastomeric material, a spring/damper-type system, a pneumatic or air bladder-type system, a hydraulic or liquid filled-type system, or the like. The compression zone portion 52 is configured to absorb in-line forces that result from the rearward travel of the firearm, thereby reducing the recoil sensation felt by the shooter in the shooter's shoulder.

The guide zone portion 54 of the recoil reducer 50 is configured to control the direction and location of the recoil forces that result during the discharge of the firearm. The guide zone portion may include a mechanical linkage that joins two or more stock segments or portions forming the stock, allowing for movement between the stock portions along the longitudinal axis 12 that is generally aligned axially with the firearm. The guide zone portion 54 is configured to receive the recoil forces that result from the discharge of the firearm, and to direct and transfer the received recoil forces in a predetermined direction. Similarly, the guide zone portion 54 is configured to limit the transfer of the recoil forces in directions other than the predetermined direction, and in effect control the transfer of recoil forces to a single degree of freedom of motion acting through the compression zone portion.

As will be discussed in more detail below, the resilient insert 90 of the compressible portion 52 of the recoil reducer 50 can comprise one or more compressible bodies or pads formed from a resilient material and aligned in series, defining the resilient insert 90. Each compressible body, and the resilient insert 90 formed thereby, will be more compliant than both the first stock portion 20 and the second stock portion 30, and is compressible by the relative motion between the two contact surfaces 28, 34. This configuration results in a "rigid-compliant-rigid" sandwich-type stock arrangement in which much of the recoil force produced by the firearm 4 is absorbed by compressible member 90 as the first stock portion 20 is urged backwards against the recoil reducer 50.

In one aspect of the present disclosure, the resilient insert 90 can comprise a single body of resilient material 91 which is substantially uniform and continuous except for a number of apertures or holes formed there through to accommodate the guide structure 60. For example, the resilient insert 90 can comprise single body made of a solid elastomeric material, a super foam material, or a material formed from a flexible matrix, and the like. In an alternative embodiment, the resilient inert can also comprise a plurality of resilient layers or bodies which are formed or assembled together to form a resilient composite structure (see FIGS. 5-6). The materials used to form each of the plurality of bodies may include similar or different materials and/or similar or different levels or resilience or compressibility, and may vary along the longitudinal axis 12 of the gun stock 10, or in a direction that is transverse to the longitudinal axis 12 of the gun stock. Typically, a resilient material 91 having a Shore hardness ranging from about 60 Shore 00 to about 90 Shore 00 (i.e. as measured on a Shore Durometer 00 hardness scale) will be used to form the resilient insert 90, although elastomeric materials having a greater or lesser Shore hardness can also be used.

Figure 4:
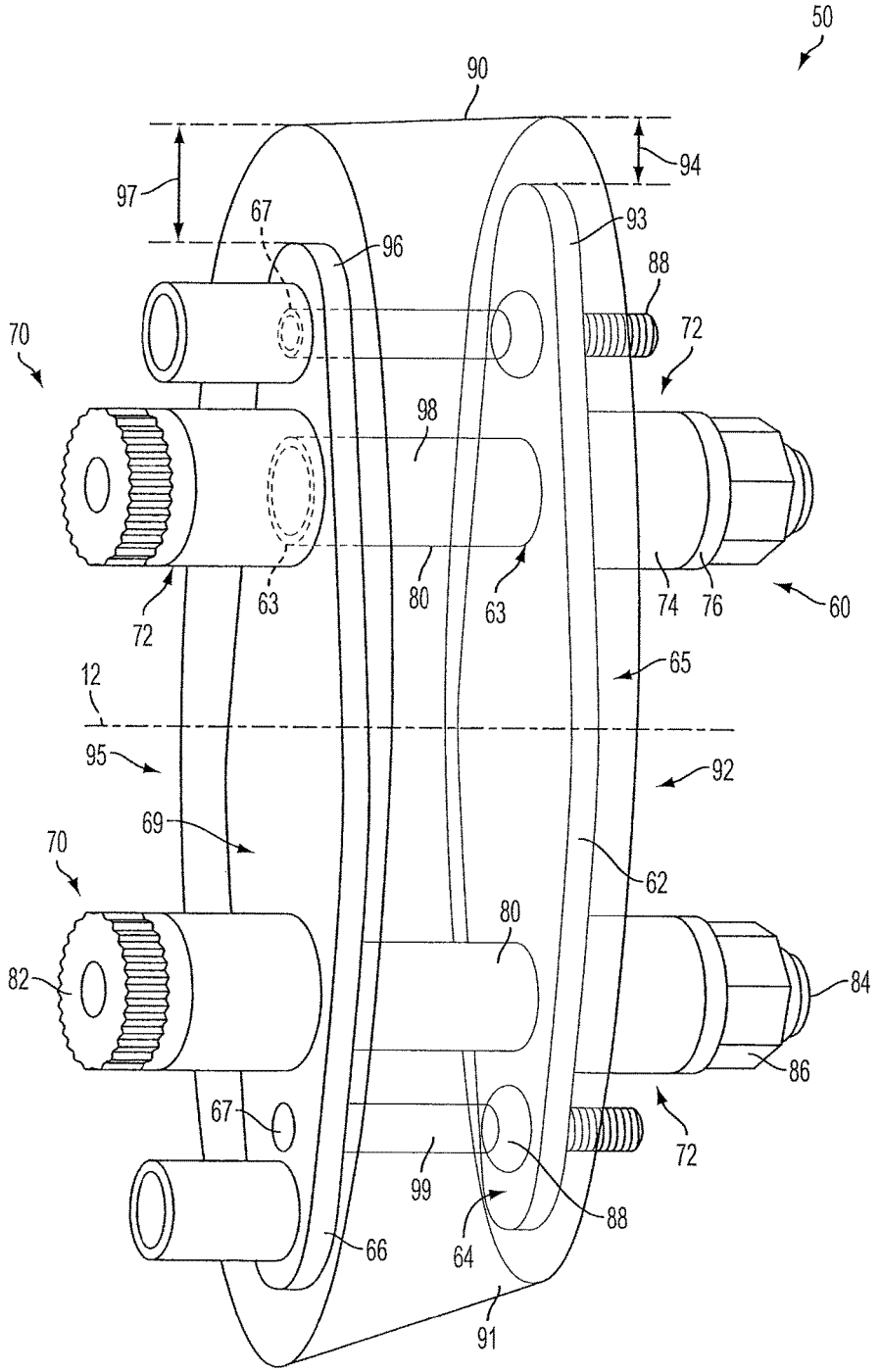
FIG. 4 is a schematic view of the guide assembly and resilient insert of the recoil reducer of FIGS. 1-2.

The resilient insert 90 of recoil reducer 50 can have a proximal face 92 which comes into contact with the distal contact surface of the first stock portion. As shown in FIG. 4, the proximal face 92 of the resilient insert 90 can include a recess 93 configured to receive a forward plate element 62 of the guide structure 60. This allows for both an outer annular portion 94 of the resilient insert's proximal face 92 and the proximal face 65 of the forward plate element 62 to directly contact and press against the distal contact surface at the first distal end of the first stock portion. In a similar fashion, the distal face 95 of the resilient insert 90 can include a recess 96 configured to receive a back plate element 66 of the guide structure 60, allowing for both an outer annular portion 97 of the resilient insert's distal face 95 and the distal face 69 of the back plate 66 to directly contact and press against the proximal contact surface at the second proximal end of the second stock portion.

As also shown in FIGS. 1-4, the stock 10 further may include a typical recoil pad 40 having a front end 42 attached to the distal end 36 of the second stock portion 30 near the butt end 18 of the gun stock 10. The recoil pad 40 of the stock 10 may also be formed from a resilient material 41, such as a similar or the same resilient material used to form the resilient insert 90 or can be formed a different pad or cushioning material. Consequently, this configuration can extend the sandwich-type configuration described above to a "rigid-compliant-rigid-compliant" arrangement which can be further effective in reducing or substantially eliminating the recoil force transmitted to the shooter of the firearm.

In the illustrated embodiment, the gun stock 10 comprises a single recoil reducer 50 positioned between two stock portions 20, 30 and with a resilient recoil pad 40 mounted to the rear surface 38 of the second stock portion 30. It is further contemplated, however, that the gun stock of the present disclosure may also comprise three or more stock portions and multiple recoil reducers mounted in a variety of configurations, including configurations where the recoil reducers and stock portions are "stacked" in an alternating fashion along the longitudinal axis 12 of the gun stock.

Either of the first stock portion 20 or the second stock portion 30 also may include a hand grip 14 for the shooter to grasp during use, as well as a cheek area 16 proximate the hand grip 14 against which the shooter may press his cheek. Similarly, either of the rear contact surface 38 of the second stock portion 30 or the back end surface 48 of the recoil pad 40 may include an area shaped to seat the butt end 18 of the stock 10 against the shooter's shoulder, so as to brace and stabilize the firearm against the recoil force during firing.

As shown in FIGS. 3-4, once the recoil reducer 50 is installed within the gun stock 10, the forward and rear plate elements 62, 66, of the guide structure 60 can become, in effect, extensions of the first stock portion 20 and second stock portion 30, guiding the movement of the first and second stock portions as they act on resilient insert 90 during a recoil event. In other embodiments, moreover, the proximal face 92 and distal face 95 of the resilient insert 90 can be completely covered by the forward plate element 62 and back plate element 66, respectively.

The forward plate element 62 of the guide structure 60 may be used to provide a structure to attach the recoil reducer 50 to the first stock portion 20, while the back plate element 66 of the guide structure 60 may be used to attach the second stock portion 30 to the recoil reducer 50, and thus link or connect the first stock portion 20 and the second stock portion 30. As a further result, axially-directed forces, including both the recoil force and any supporting forces, are transferred from the first stock portion to the second stock portion through the resilient insert 90 of the recoil reducer 50, which cushions and/or dampens these axial forces to reduce the recoil felt by the shooter.

The forward plate element 62 and the rear plate element 66 can be coupled together with one or more guide rod assemblies 70, each of which can include a bolt 80 or similar fastener slidably inserted through bolt apertures 63 in the plate elements 62, 66, respectively, and through bolt apertures 98 in the resilient inert 90. The outer ends of the bolts 80 can be secured to the proximal face 65 of the forward plate element 62 and to the distal face 69 of the rear plate element 66 with standoff assemblies 72. The standoff assemblies 72 can include elongate tubular elements 74 and flat washers 76, with the flat washers contacting bolt heads 82 on one side of the recoil reducer 50 and nuts 86 threaded onto the threaded portions 84 of the bolts on the other.

The elongate tubular elements 74 can operate to increase the length of the lines of contact between the bolts 80 and the forward and rear plate elements 62, 66 at the bolt apertures 63, which in turn serves to keep the forward and rear plate elements 62, 66 aligned and perpendicular with the bolts 80 when the resilient insert 90 is compressed. In addition, the bolts 80, plate elements 62, 66 and the elongate tubular elements 74 can together support the second stock portion 30 of the gun stock 10 against transversely-directed shear forces, such as gravity, and thus prevent the second stock portion 30 from tilting or sagging relative to the first stock portion 20. In one aspect, the elongate tubular elements 74 can be formed integral with the forward and rear plate elements 62, 66 as plate assemblies having outwardly-projecting tubular bosses. In other aspects, the elongate tubular elements 74 can be separate tubular washers mounted to the plate elements 62, 66 around the bolt apertures 63. The forward and rear plate elements 62, 66 and the elongate tubular elements 74 can be made of metal, hard plastic or a similar rigid material.

The bolt apertures 63 and standoff assemblies 72 of the forward and rear plate elements 62, 66 can be sized for a cooperative sliding fit around the shafts of the bolts 80, so that the plate elements 62, 66 can slide back and forth over the bolts 80 in the axial direction. Thus, once the forward plate element 62 has been fixed to the first stock portion 20 and the rear plate element 66 has been fixed to the second stock portion 30, the stock portions of the gun stock are also placed in cooperative sliding engagement with guide structure 60 of the recoil reducer 50, and which is operable to constrain the relative motion between the stock portions with respect to the longitudinal axis of the stock.

Engagement and tightening of the nuts 86 onto the threaded portions 84 of bolts 80 of the guide structure 60 allows the resilient insert 90 to be pre-compressed, or preloaded, to a desired amount. Preloading the resilient insert 90 can be desirable in order to better control and/or adjust the stiffness and damping provided to the stock by the resilient insert 90, as well as to ensure that the recoil reducer 50 provides support sufficient to securely connect the second stock portion 30 to the forward stock portion 20 and form a unified and stable gun stock 10 (see FIGS. 1-2). In addition, the configuration of the bolts 88 and nuts 86 of the guide structure 60 can also allow the preloading on the resilient insert 90 to be periodically adjusted (e.g. tightened) to compensate for any loss in the elasticity of the resilient material 91 over time.

Further illustrated in FIGS. 3-4, the recoil reducer 50 can be attached first to the first stock portion 20 with attachment screws 88 having screw heads which bear against the distal or inside face 64 of the forward plate element 62 as they pull the proximal face 65 of the forward plate element 62 and the outer annular portion 94 of the resilient insert's proximal face 92 into contact with the distal contact surface 28 of the first stock portion 20. In one aspect, screw apertures 67 formed into back plate element 66 and screw apertures 99 formed into the resilient insert 90, respectively, can provide access to the heads of the attachment screws 88, so that the recoil reducer 50 may be attached to the distal contact surface 28 of the first stock portion 20 before the second stock portion 30 is attached to the recoil reducer 50.

The distal end 26 of the first stock portion 20 can also include holes or recesses 29 which are sized to accommodate the standoff assemblies 72 which project outwardly from the forward plate element 62. Because the forward plate element 62 is attached to the distal end 26 of the first stock portion 20 with the separate set of attachment screws 88, as described above, the recesses 29 can be sized to accommodate the standoff assemblies 72 with a loose or clearance fit, and with additional axial space to accommodate the threaded ends 84 of the bolts 80 as the first stock portion 20 moves rearward in response to the recoil forces generated during the firing of the firearm. Because the bolts 80 can remain fixed in space relative to the second stock portion 30, this additional axial space can provide the clearance for the first stock portion 20 to move rearward to compress the resilient insert 90 without butting up against the threaded end 84 of the bolts 80.

Similar holes or recesses 33 can be formed into the proximal end 32 of the second stock portion 30 to accommodate the standoff assemblies 72 which project outwardly from the rear plate element 66. Thus, the length of the second stock portion 30 in the axial direction can be at least as long as the portion of the guide rod assembly 70 that projects outwardly form the rear plate element 66, which can include the elongate tubular element 74, the flat washer 76, and the bolt head 82. Moreover, in one aspect a back end recesses 39 may also be formed in the distal end 36 of the second stock portion 30 to provide access to another set of attachment screws (not shown) which connect the second stock portion 30 to the recoil reducer 50, and for the attachment features connecting the recoil pad 40 to the rear surface 38 located at the distal end 36 of the second stock portion 30.

The design of the guide structure 60, in conjunction with the design of the resilient insert 90, can be configured to control the motion of the recoil reducer 50 generally to a linear translation aligned with the longitudinal axis 12 of the gun stock 10. This motion can be controlled predominately by the one or more guide rod assemblies 70 having a rigid bolt 80 suspended between two standoff assemblies 72, with the rigid bolts 80 and standoff assemblies 72 being orientated substantially parallel to the longitudinal axis 12 of the gun stock 10 and thereby guiding the relative motion between the forward plate element 62 and the back plate element 66 along the axis 12 of the gun stock.

During firing of the firearm, the generated recoil forces will urge the first stock portion 20 back into the recoil reducer 50, which compresses along the longitudinal axis 12 as it absorbs and dampens the recoil forces. Assuming that the shoulder of the shooter provides a firm support base, the second stock portion 30 generally will remain substantially fixed as the recoil reducer is compressed there against. Alternatively, and depending on the stiffness and thickness of a recoil pad 40 attached to the rear contact surface 38, the second stock portion 30 can also be moved backwards along the longitudinal axis 12, but not to the same degree as the first stock portion 20.

In one aspect, having the motion of the recoil reducer 50 controlled by the internal guide structure 60 described and illustrated above, can prevent the resilient insert 90 from bowing asymmetrically or from buckling to one side as it absorbs the recoil forces. Thus, the recoil reducer 50 of the present disclosure can overcome the deficiencies in the prior art by providing for an improved reduction in recoil forces without a decrease in stability. The recoil reducer 50 of the present disclosure may offer further advantages over the gun stock designs found in the prior art. For example, the resilient insert 90 of the present disclosure may be interchangeable with a variety of other resilient inserts having different dimensions and shapes and being formed from a variety of resilient materials. This may allow the shooter to customize the dimensions of the gun stock, as well as its shock absorbing capabilities, to better match the individual shooter's size and shooting style. Furthermore, in designs having both the resilient insert 90 and the recoil pad 40 being formed from resilient, shock absorbing materials, the two components may be customized or configured together as a unit to meet specific performance demands, and thus may be provided or sold as a matching set. Alternatively, the outer dimensions and attachment systems for the resilient inserts 90 and the recoil pads 40 may be standardized so that different shooters can mix and match the various components having different characteristics in order to reach the ideal setup for the individual.

Figure 5:
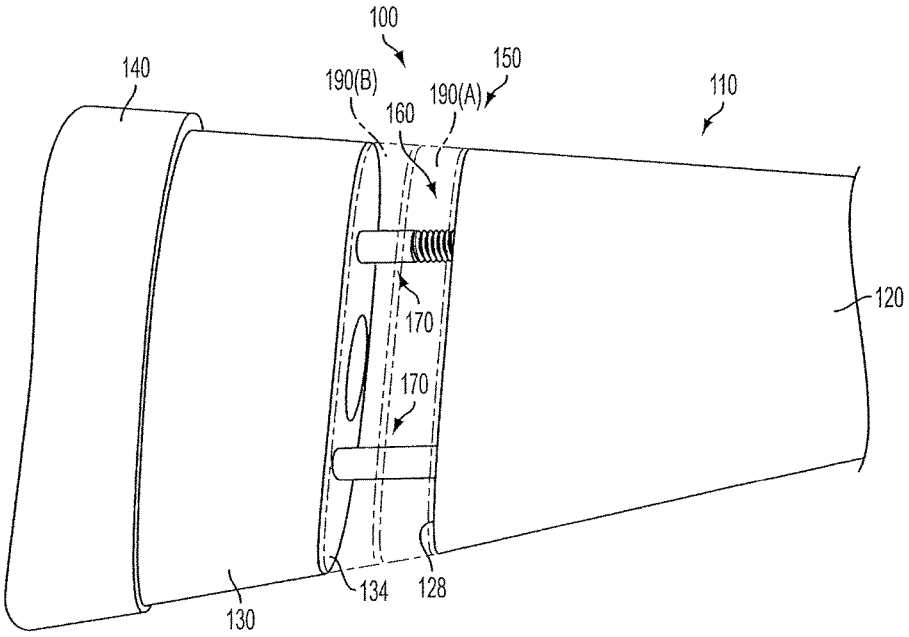
FIG. 5 is a side view of a gun stock with a recoil reducer in accordance with another representative embodiment of the disclosure, showing the guide rods of the recoil reducer.
Figure 6:
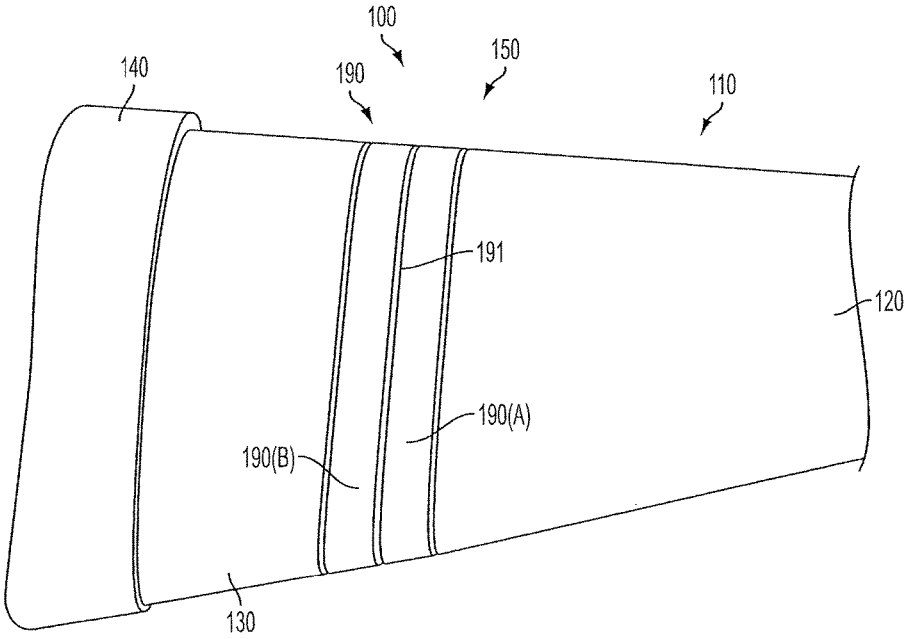
FIG. 6 is a side view of the gun stock of FIG. 5 illustrating compression of the resilient insert of the recoil reducer, in accordance with the principles of the present invention.

Illustrated in FIGS. 5 and 6 is another embodiment of the system 100 for reducing a recoil force transmitted upon firing of a firearm, which system includes a gun stock 110 having a first stock portion 120, a second stock portion 130, a recoil pad 140 made from a resilient material 141, and a recoil reducer 150 that includes a dual-body insert 190 that can also be made from a resilient material. As shown in FIG. 6, the dual-body insert 190 can comprise multiple insert bodies or pads 190A, 190B arranged in stacked series.

In the system 100 of FIGS. 5 and 6, the dual-body insert 190 of the recoil reducer 150 can includes a series of pads/resilient bodies 190A, 190B adhered together to form an integrated composite insert 190, or the resilient bodies can be separated by a gasket or support plate 191. This support plate can be a rigid or semi-rigid material having a different elasticity from the resilient bodies 190A, 190B as needed to provide addition support to the resilient bodies and to help resist undesired movement between the resilient bodies during operation. The resilient bodies 190A, 190 B further can be formed from the same or different elastomeric materials and/or can have different elasticities and compression characteristics to provide different damping effects.

The guide structure 160 of the recoil reducer 150 is shown in FIG. 5, and can include two guide rod assemblies 170 that extend through the one or more resilient insert bodies to be slidably engaged with at least one of the first stock portion 120 and the second stock portion 130, so that the resilient insert could be compressed by the relative motion between the distal contact surface 128 for the first stock portion 120 and the proximal contact surface 134 of the second stock portion 130.

Figure 7:
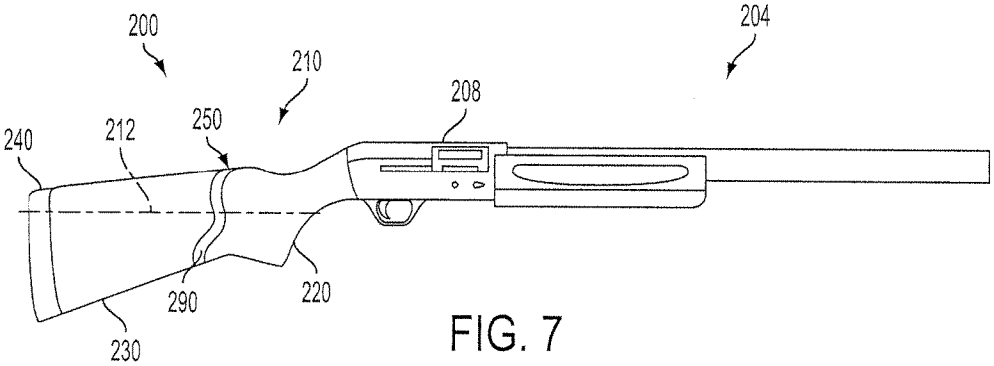
FIG. 7 is a perspective view of a firearm, gun stock and recoil reducer, in accordance with another representative embodiment of the disclosure.
Figure 8:
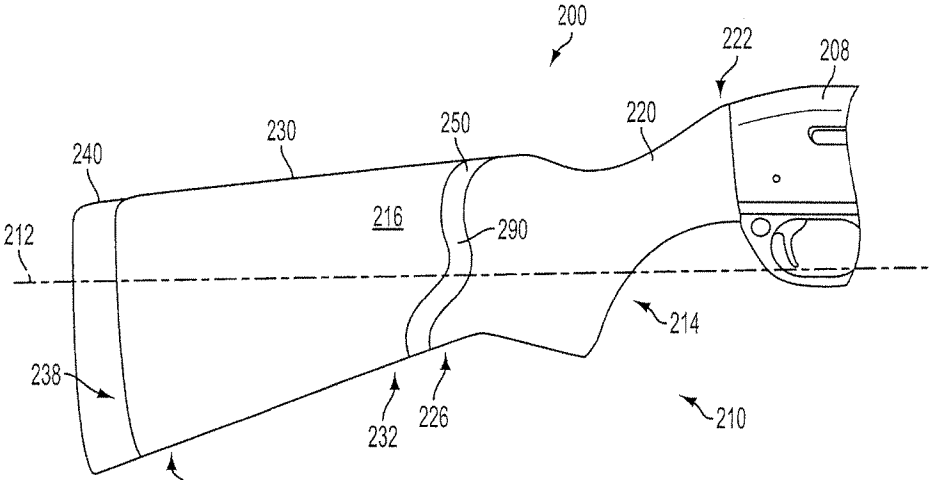
FIG. 8 is a close-up side view of gun stock and recoil reducer of FIG. 7.

Another embodiment of the system 200 for reducing a recoil force transmitted upon firing of a firearm is illustrated in FIGS. 7-8. The system includes a first stock portion 220 of a gun stock 210 having a proximal end 222 attached to the receiver 208 of the firearm 204 and a distal end 226 attached to a recoil reducer 250. The recoil reducer 250 includes a resilient insert 290 made from a resilient material. The system further includes a second stock portion 230 of the gun stock 210 having a proximal end 232 attached to the recoil reducer 250. In one aspect, the system 200 further includes a recoil pad 240 attached to the rear surface 238 at the distal end 236 of the second stock portion 230. The recoil pad can also be made from a resilient material. In another aspect, the system 200 for reducing the recoil force differs from those described above in that the position of the recoil reducer 250 has been moved forward along the long axis 212 of the gun stock 210 to a location proximate the hand grip 214 and forward of the cheek area 216 of the gun stock 210.

During firing of the firearm, the generated recoil forces will push the first stock portion 220 back into the recoil reducer 250, which compresses along the longitudinal axis 212 as it absorbs and dampens the recoil forces. Here again, most of the motion of the first stock portion 220 will not be carried back across recoil reducer 250 to the second stock portion 230. Because the location of the recoil reducer 250 is now forward of the shooter's face, however, the cheek area portion 216 of the gun stock 210 which may contact the shooter's face will experience very little motion, even as the amplitude of the recoil force being transmitted to the shooter is significantly reduced. This combination of features can be advantageous by simultaneously reducing multiple negative gun recoil affects, namely the sharp and painful impacts on the shooter's shoulder and the uncomfortable rubbing on the shooter's cheek. Moreover, these benefits can be accomplished without a reduction is the gun's stability, and therefore can allow the shooter to concentrate more on the mechanics of firing the firearm.

Figure 9:
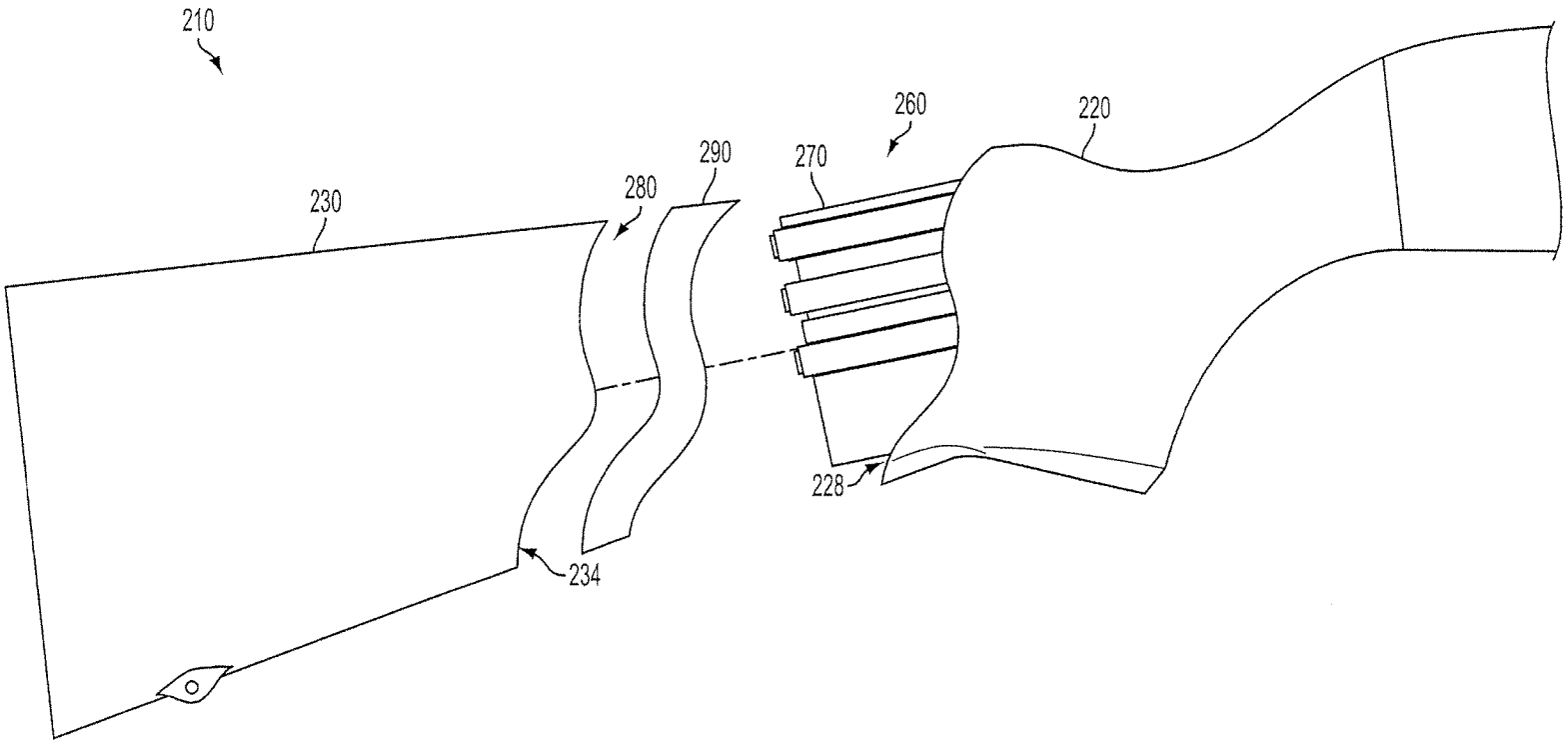
FIG. 9 is an exploded side view illustrating the guide structure and resilient insert of the recoil reducer of FIGS. 7-8.
Figure 10A:
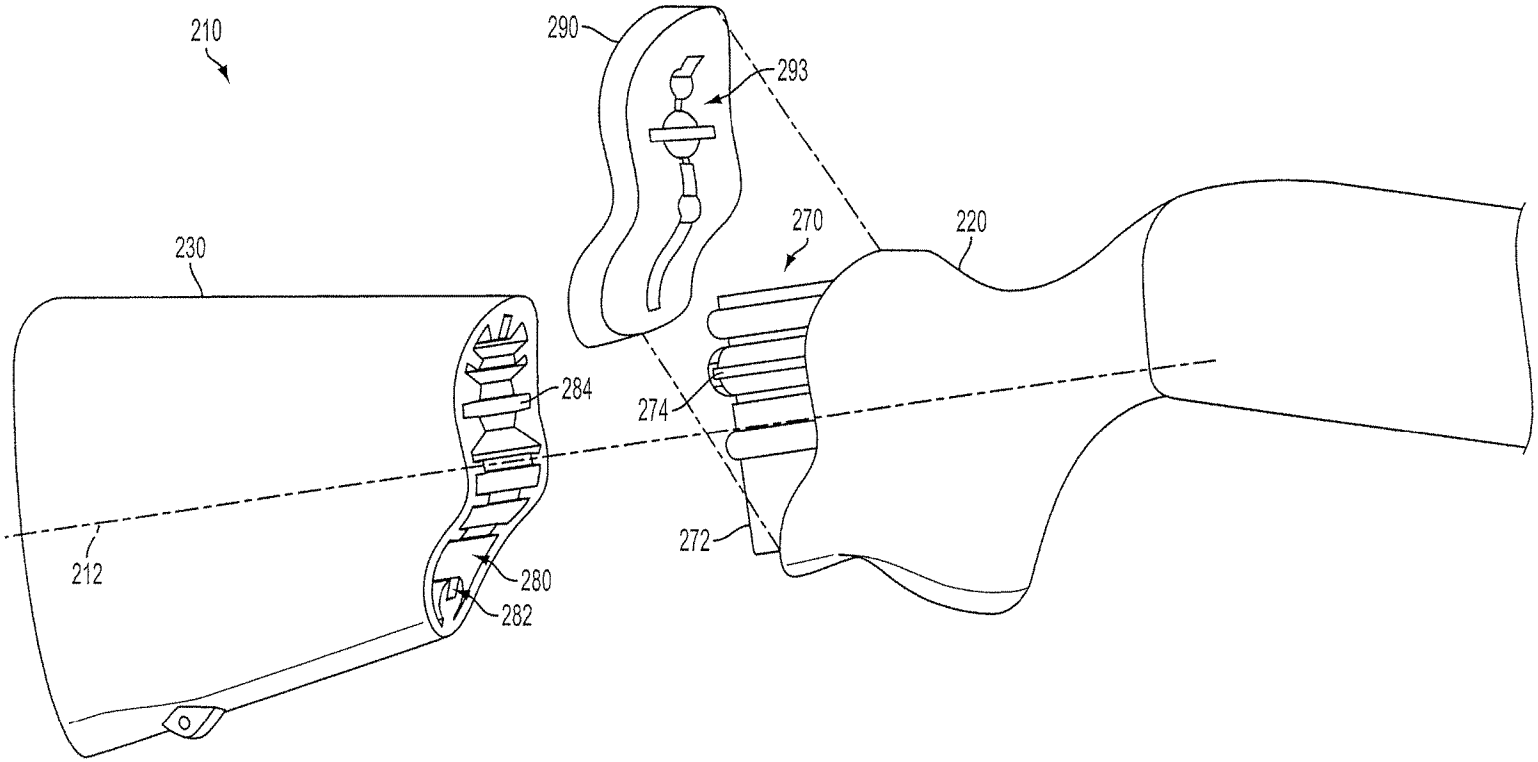
FIGS. 10A-10B are perspective illustrations of the guide structure of FIGS. 7-9.
Figure 10B:
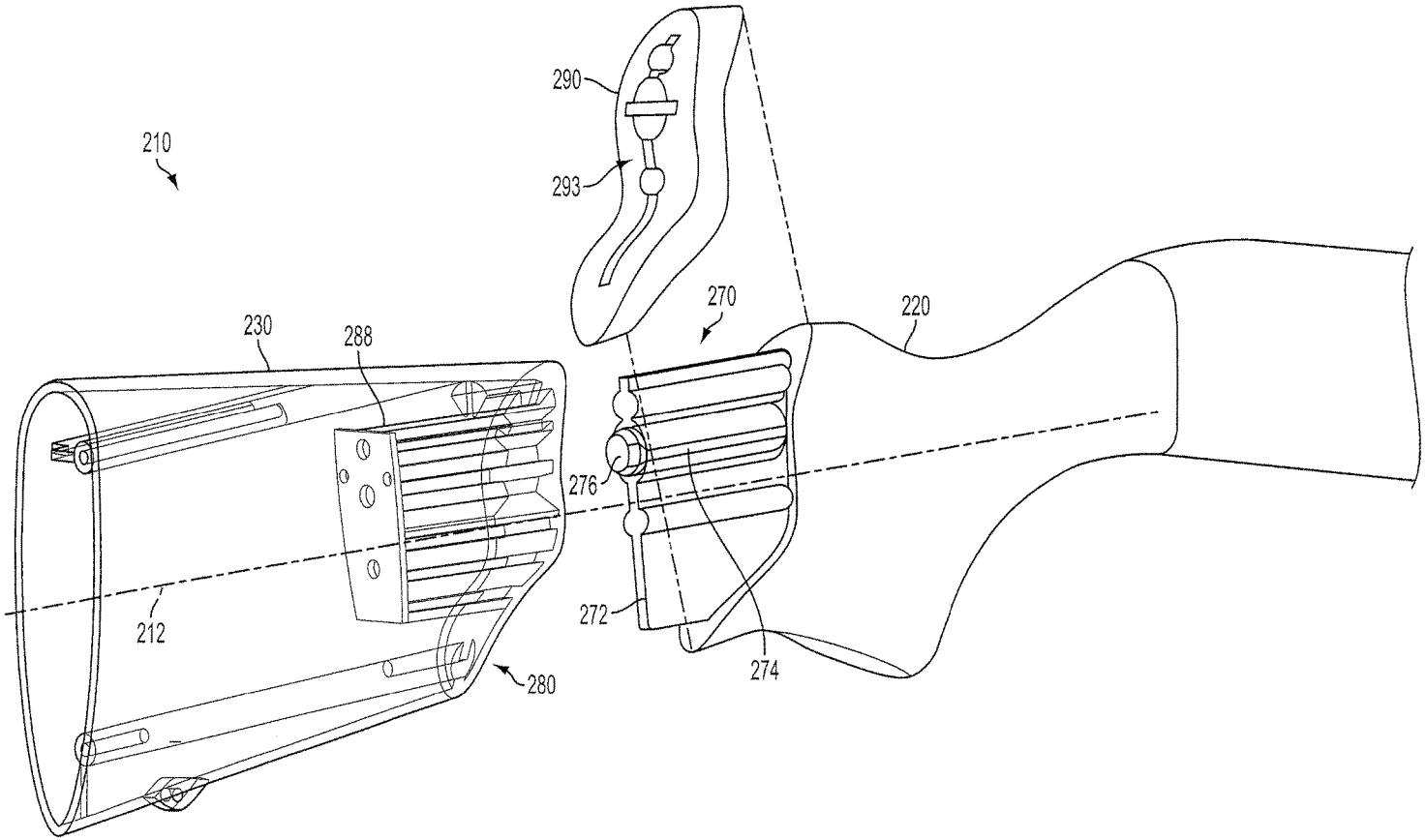

The guide zone portion and the compression zone portion of the recoil reducer 250 are shown in more detail in FIGS. 9 and 10A, 10B. Referring first to FIG. 9, the guide zone portion can include a guide structure 260 comprising a single guide rod 270 projecting from the distal face 228 of the first stock portion 220. The guide rod 270 is configured for sliding engagement within a complementary recess 280 formed into the proximal face 234 of the second stock portion 230. The cooperative sliding engagement between the guide rod 270 and the recess 280 can be configured to control the relative motion between the first contact surface 228 and the second contact surface 234 to substantially a single degree of freedom of motion. With the resilient insert 290 of the compression zone portion installed over the guide rod 270 and between the first contact surface 228 and the second contact surface 234, as shown in FIG. 9, the insert 290 is therefore compressible by the relative motion between the first contact surface 228 and the second contact surface 234. Of course, the association of the guide rod 270 with the first stock portion 220 and the recess 280 with the second stock portion 230 may be arbitrary, and the configuration may be reversed with the guide rod extending forwardly from the second stock portion 230 for sliding engagement within a recess formed into the first stock portion.

Additional details of the single guide rod 270 and complementary recess 280 of the exemplary recoil reducer 250 are shown in FIGS. 10A-10B. As can be seen, the guide rod 270 can extend through an aperture 293 formed into a center portion of the insert 290. The guide rod 270 can comprise a complex structure that includes one or more vertical ribs 272 and one or more horizontal ribs 274. The vertical ribs 272 on the guide rod 270 can be slidably engaged with vertically-oriented slots 282 in the recess 280 to limit side-to-side translation and rotation (e.g. yaw) between the two substantially rigid bodies. In a similar fashion, horizontal ribs 274 on the guide rod 270 can be slidably engaged with horizontally-oriented slots 284 in the recess 280 to limit up-and-down translation and rotation (e.g. pitch) between the two rigid bodies. As known to one of skill in the art, both the vertical and horizontal members will also operate to limit rotation about the longitudinal axis 212 (e.g. roll). Thus, the vertically-oriented and horizontally-orientated ribs and slots can operate to control the relative movement between the first stock portion 220 and the second stock portion 230 to a single degree of freedom, namely translation forward-and-back along the longitudinal axis 212 of the gun stock 210.

Also shown in FIG. 10B, the single guide rod 270 may be formed integral with the first stock portion 220, or may be formed separately and then rigidly coupled to the first stock portion 220 with a fastener, such as bolt 276. In one aspect, the bolt 276 can extend through the guide rod 270 and the first stock portion 220 to engage with a threaded portion formed within the receiver, so as to couple the first stock portion 220 and the guide rod 270 to the receiver. Similarly, the recess 280 can comprise an internal structure 288 which can be formed integral with the second stock portion 230, or may be formed separately and assembled together prior to assembly of the stock 210.

Screws (not shown) may be installed through clearance apertures in a back plate of the recess structure 288 and into threaded portions formed into the guide rod 270, with the heads of the screws being pressed against the back plate to secure the second stock portion 230 to the first stock portion 220. In this manner, the second stock portion 230 may not be withdrawn from the first stock portion 220, but the first stock portion 220 will still free to move rearward toward the second stock portion 230 in response to the recoil forces generated during the firing of the firearm and to compress the resilient insert 290.

Other methods for coupling the guide rod 270 to either of the first or second stock portions 220, 230, for forming the components as integral members, or for forming the complementary recesses 280 into either or both of the forward and second stock portions 220, 230, are known to those of skill in the art and are considered to fall within the scope of the present disclosure.

Figure 11:
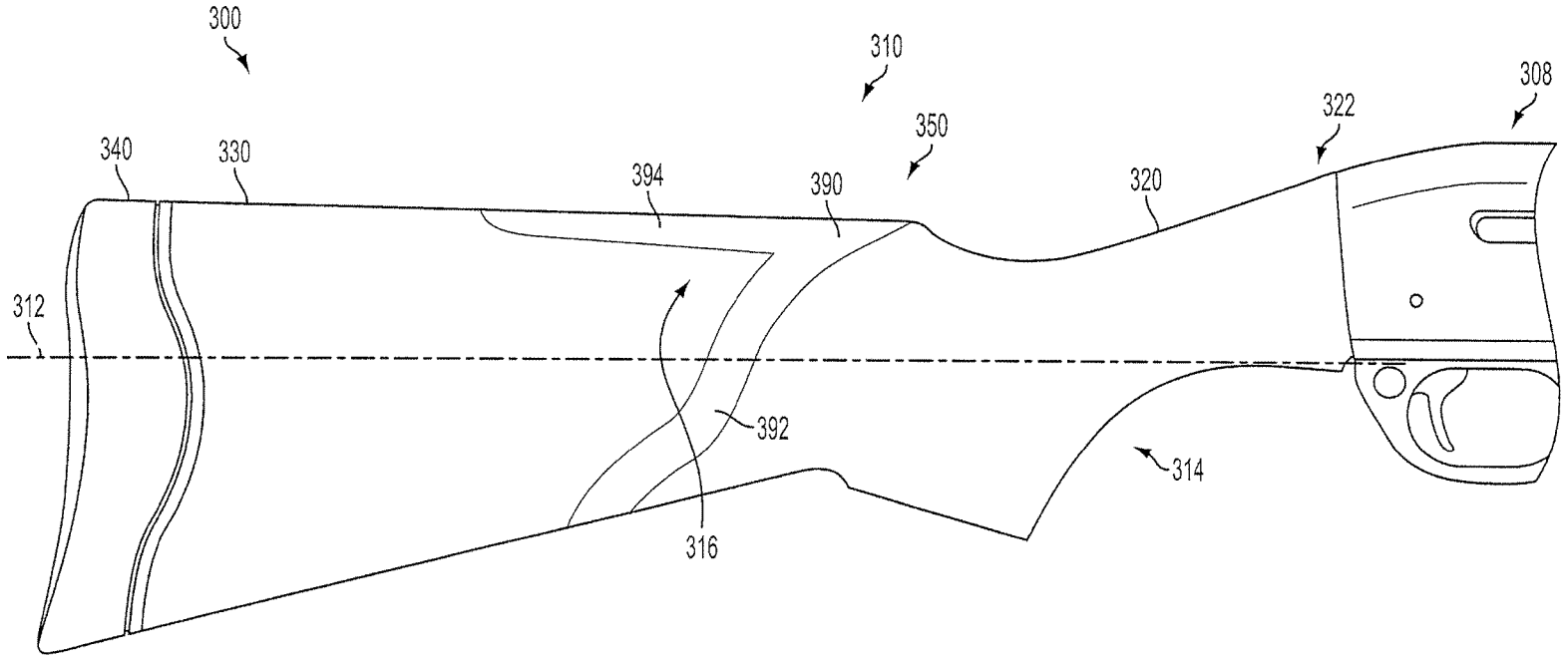
FIG. 11 is a side view of a gun stock having a recoil reducer with a combined cheek pad, in accordance with yet another representative embodiment of the disclosure.

Yet another exemplary embodiment of the system 300 for reducing a recoil force transmitted upon firing of a firearm is illustrated in FIG. 11. As with the embodiments describe above, the system includes a forward (e.g., first) stock portion 320 of a gun stock 310, a rearward (e.g., second) stock portion 330, a recoil pad 340 made from a resilient material, and recoil reducer 350 that includes a resilient insert 390 also made from a resilient material. As with the previously-described embodiment, the position of the recoil reducer 350 has been moved forward along the long axis 312 of the gun stock 310 to a location proximate the hand grip 314 and forward of the cheek area 316 of the gun stock 310, so that cheek area portion 316 of the gun stock 310 contacting the shooter's face will experience very little motion. Although not shown, an internal guide structure similar to that described with reference to FIGS. 7-9 and 10A-10B above can be used to couple together the first stock portion 320 and the second stock portion 330 of the gun stock 310.

In this embodiment of the system 300 for reducing recoil force, however, the recoil reducer 350 has been configured with a more complex shape. More specifically, the recoil reducer 350 includes a resilient insert 390 having both a transverse portion 392 (e.g. substantially transverse to the longitudinal axis 312 of the gun stock 310) and a top extension 394 that is substantially parallel with the longitudinal axis 312. The top extension 394 can provide additional flexibility in controlling the stiffness and response of the resilient insert 390. In one aspect, the top extension 394 can further comprise a combined cheek piece or pad of the resilient insert 390 that provides a cheek contact surface along the top portion of the stock 310 for contacting the face of the shooter.

Figure 12:
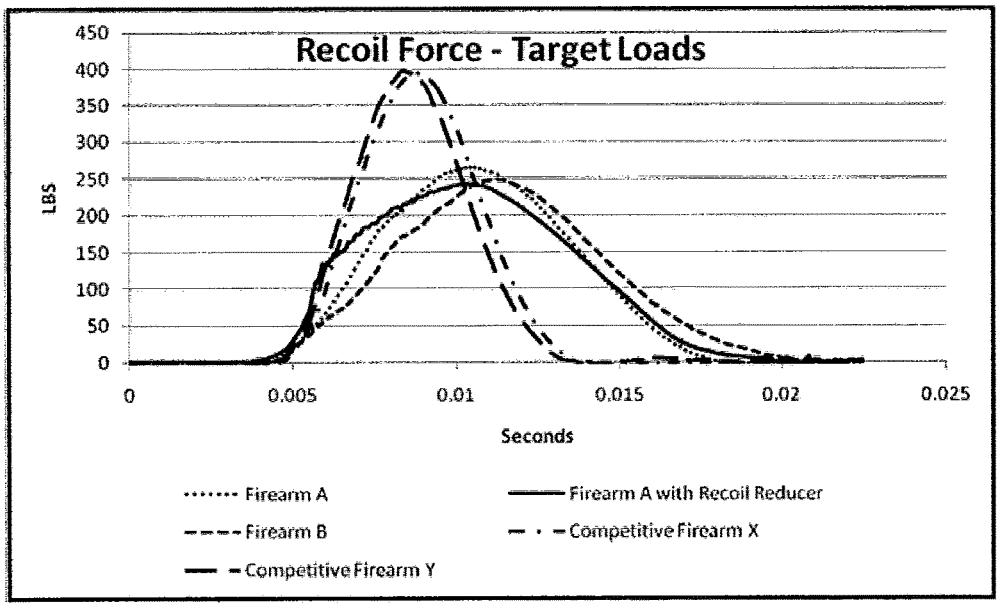
FIG. 12 is a graph illustrating Force vs. Time Curves for various firearms firing standard target load shotgun shells.
Figure 13:
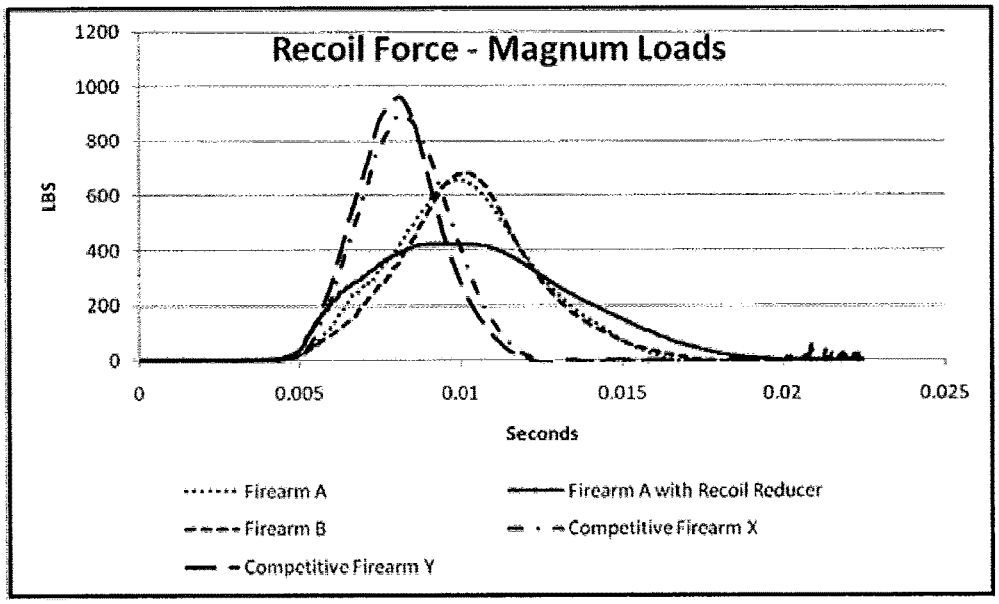
FIG. 13 is a graph illustrating Force vs. Time Curves for various firearms firing magnum load shotgun shells.

Some of the results from laboratory testing of an exemplary recoil reducer are included in the graphs provided in FIGS. 12 and 13, which demonstrate the reduction in recoil force which may be achieved through the application of the recoil reducer-equipped gun stocks. For instance, FIG. 12 is an exemplary compilation of "Force Over Time" curves for a selection of shotguns firing standard target load shotgun shells, with one of the shotguns having a recoil reducer-equipped gun stock. FIG. 13 is a similar compilation of "Force Over Time" curves for the same selection of shotguns and gunstocks, but with the guns firing a more powerful magnum load shotgun shell. As can be seen, the firearm equipped with a system for reducing recoil force, similar to the embodiments described above, experienced a reduction and extension of the force impulse transferred from the first stock portion to the second stock portion.

The corresponding structures, materials, acts, and equivalents of all means plus function elements in any claims below are intended to include any structure, material, or acts for performing the function in combination with other claim elements as specifically claimed.

Those skilled in the art will appreciate that many modifications to the exemplary embodiments are possible without departing from the scope of the invention. In addition, it is possible to use some of the features of the embodiments described without the corresponding use of the other features. Accordingly, the foregoing description of the exemplary embodiments is provided for the purpose of illustrating the principle of the invention, and not in limitation thereof, since the scope of the invention is defined solely be the appended claims.

What is claimed:

1. A firearm comprising:

a receiver; and a stock, the stock comprising:

a first stock portion having a first proximal face and a first distal face, the first proximal face being configured for coupling to the receiver;

a second stock portion spaced apart from the first stock portion and having a second proximal face and a second distal face, the second distal face defining a butt end of the stock; and a recoil reducer located within the stock between the first stock portion and the second stock portion to substantially reduce a recoil force transmitted through the stock, the first stock portion, second stock portion and recoil reducer defining a substantially unitary stock, and wherein the recoil reducer comprises:

a guide extending between the first stock portion and the second stock portion to direct a relative motion between the first distal face and the second proximal face; and a resilient insert positioned between the first stock portion and the second stock portion, the resilient insert being compressible by the relative motion between the first distal face of the first stock portion and the second proximal face of the second stock portion, the insert including at least one body of a compressible, resilient material with a modulus of elasticity sufficient to reduce the recoil force transmitted through the stock upon firing of the firearm as the insert is compressed by the relative motion between the distal face of the first stock portion and the proximal face of the second stock portion.

2. The firearm of claim 1, wherein the guide extends through the resilient insert.

3. The firearm of claim 1, wherein the resilient insert comprises at least one substantially solid body having at least one aperture formed there through for receiving the guide.

4. The firearm of claim 1, wherein the resilient insert is formed from an elastomeric material.

5. The device of claim 1, wherein the guide is rigidly coupled to one of the first stock portion and the second stock portion and slidably coupled to the other of the first stock portion and the second stock portion.

6. The firearm of claim 1, wherein the guide further comprises:

at least one guide rod, a first plate assembly coupling the at least one guide rod to the first distal face of the first stock portion; and a second plate assembly coupling the at least one guide rod to the second proximal face of the second stock portion.

7. The firearm of claim 1, wherein an outer surface of the resilient insert is generally continuous with an outer surface of each of the first stock portion and the second stock portion.

8. A method of reducing a recoil force transmitted through a firearm stock of a firearm to a user of the firearm upon firing of the firearm, the method comprising:

moving a first stock portion of the firearm stock toward a second stock portion of the firearm stock, the first stock portion including a first proximal end coupled to a receiver of the firearm and a first distal end having a distal contact surface, the second stock portion including a second proximal end having a proximal contact surface and a second distal end having a rear surface;

as the first stock portion moves toward the second stock portion, directing the first stock portion in a substantially linear path toward the second stock portion;

compressing a resilient insert located within the firearm stock between the first and second stock portions, the insert including at least one resilient material body having a modulus of elasticity sufficient to reduce the recoil force transmitted through the first stock portion to the second stock portion upon firing of the firearm through compression of the insert by relative motion between the distal face of the first stock portion and the proximal face of the second stock portion; and as the recoil force dissipates, decompressing the resilient insert so as to move at least one of the first and second stock portions away from the other of the first and second stock portions.

9. The method of claim 8, wherein the first and second stock portions comprise a rigid material, and further comprising coupling a resilient pad to the rear surface of the second stock portion to form a sandwich structure having an alternating rigid, resilient, rigid, resilient material construction.

10. The method of claim 8, wherein directing the first stock portion in a linear path toward the second stock portion comprises moving the first stock portion along at least one guide rod extending through the resilient insert and into the second stock portion.

11. The method of claim 8, wherein an outer surface of the resilient insert is generally continuous with an outer surface of each of the first stock portion and the second stock portion.

12. A firearm stock adapted to provide a reduction in a recoil force generated upon firing the firearm, comprising:

a first stock portion formed from a substantially rigid material, and including a proximal end coupled to a receiver of the firearm and a distal end defining a distal contact surface;

a second stock portion coupled to the first stock portion, the second stock portion formed from a substantially rigid material, and including a proximal end having a proximal contact surface spaced from the distal contact surface of the first stock portion, and distal end defining a rear surface of the firearm stock;

a recoil reducer received between the spaced distal contact surface of the first stock portion and the proximal contact surface of the second stock portion and comprising a resilient insert including one or more resilient material bodies, each formed from a resilient material having a hardness less than a hardness of the substantially rigid material of the first and second stock portions, and which resists compression to an extent sufficient to substantially dampen the recoil force transmitted through the firearm stock from the first stock portion to the second stock portion of the firearm stock as the one or more resilient material bodies are engaged between the distal contact surface of the first stock portion and the proximal contact surface of the second stock portions; and wherein the first and second stock portions and the recoil reducer received therebetween define a substantially unitary structure for the firearm stock.

13. The firearm stock of claim 12, further comprises at least one guide structure mounted between the first and second stock portions, extending through the resilient insert, and configured to control the motion between the first and second stock portions in response to the recoil force to substantially a single direction.

14. The firearm stock of claim 13, wherein the at least one guide structure is rigidly coupled to one of the first stock portion and the second stock portion and is slidably coupled to the other one of the first stock portion and the second stock portion.

15. The firearm stock of claim 13, wherein the at least one guide structure further comprises:

a first guide portion proximate the resilient insert and having a proximal face defining the distal contact surface of the first stock portion;

a second guide portion proximate the resilient insert and having a distal face defining the proximal contact surface of the second stock portion; and at least one guide rod extending between the first guide portion and the second guide portion.

16. The firearm stock of claim 12, wherein the compressible material of the one or more bodies of the resilient insert comprises an elastomeric material.

17. The firearm stock of claim 16, wherein the elastomeric material comprises a Shore hardness ranging from 60 Shore 00 to 90 Shore 00, as measured on a Shore Durometer 00 hardness scale.

18. The firearm stock of claim 16, wherein the resilient insert comprises at least two resilient material bodies arranged in stacked series between the first and second stock portions.

19. The firearm stock of claim 18, wherein the resilient material bodies each comprise a different elastomeric material having a different Shore hardness.

20. The firearm stock of claim 12, wherein the second stock portion further comprises a cheek contact surface for contacting a cheek of the user, and wherein the resilient insert is positioned between the receiver of the firearm and the cheek contact surface.

21. The firearm stock of claim 12, further comprising a resilient pad coupled to the rear surface of the distal end the second stock portion.

22. The firearm stock of claim 12, wherein an outer surface of the resilient insert is generally continuous with an outer surface of each of the first stock portion and the second stock portion.

23. The firearm stock of claim 12, wherein the resilient insert comprises at least two resilient material bodies arranged in stacked series between the first and second stock portions, and each resilient material body is at least partially in contact with an adjacent resilient material body of the at least two resilient material bodies.

24. The firearm stock of claim 15, wherein the at least one guide structure further comprises at least one rib through which the at least one guide rod extends, the at least one rib extending in a direction substantially perpendicular to a direction of the relative motion.

25. A firearm stock adapted to provide a reduction in a recoil force generated upon firing the firearm, comprising:

a first stock portion coupled to and extending from a receiver of the firearm, the first stock portion comprising a first contact surface;

a second stock portion coupled to the first stock portion and comprising a second contact surface spaced from the first contact surface, and a rear end of the second stock portion opposite to the second contact surface defining a rearmost end of the entire firearm stock;

a recoil reducer incorporated between the first contact surface of the first stock portion and the second contact surface of the second stock portion so that the first stock portion, the recoil reducer, and the second stock portion form the firearm stock;

wherein the recoil reducer comprises at least one compressible body formed from a resilient material that is more compliant than the first stock portion and the second stock portion so as to be compressed by movement of the first stock portion toward the second stock portion, the at least one compressible body being sufficiently compressible to absorb at least a portion of the recoil force of the firearm as the first stock portion is moved toward the second stock portion.

26. The firearm stock of claim 25, wherein a recoil pad is mounted to the rearmost end of the rear end of the second stock portion.

27. The firearm stock of claim 25, further comprising at least one guide structure mounted between the first and second stock portions and extending through the at least one compressible body, the at least one guide structure including a first guide portion proximate the at least one compressible body and having a proximal face defining the first contact surface of the first stock portion; a second guide portion proximate the compressible body and having a distal face defining the second contact surface of the second stock portion; and at least two guide rods extending between the first guide portion and the second guide portion.

28. The firearm stock of claim 25, wherein the resilient material of the at least one compressible body of the recoil reducer comprises an elastomeric material.

29. The firearm stock of claim 28, wherein the elastomeric material comprises a Shore hardness ranging from 60 Shore 00 to 90 Shore 00, as measured on a Shore Durometer 00 hardness scale.

30. The firearm stock of claim 28, wherein the at least one compressible body comprises at least a first compressible body and a second compressible body arranged in stacked series between the first and second stock portions.

31. The firearm stock of claim 30, wherein each of the first compressible body and the second compressible body comprises a different elastomeric material having a different Shore hardness.

32. The firearm stock of claim 25, wherein an outer surface of the resilient insert is generally continuous with an outer surface of each of the first stock portion and the second stock portion.

33. The firearm stock of claim 25, wherein the at least one compressible body comprises at least a first compressible body and a second compressible body arranged in stacked series between the first and second stock portions, and the first compressible body is at least partially in contact with the second compressible body.

* * * * *